US006161278A

United States Patent [19]

Easter et al.

[11] Patent Number: 6,161,278

[45] Date of Patent: Dec. 19, 2000

[54] METHOD FOR INSERTING WIRES INTO A TELEPHONE JACK CONNECTOR

[75] Inventors: William Easter; Dale Evans; John Maze; Frank Miceli, all of Orlando, Fla.

[73] Assignee: Lucent Technologies Inc., Murray Hill, N.J.

[21] Appl. No.: 09/376,801

[22] Filed: Aug. 18, 1999

[51] Int. Cl.[7] ..... H01R 43/00

[52] U.S. Cl. ..... 29/749; 29/750; 29/566.4

[58] Field of Search ..... 29/566.4, 720, 29/749, 750

[56] References Cited

U.S. PATENT DOCUMENTS

| | | | |
|---|---|---|---|
| 3,758,935 | 9/1973 | Long et al. . | |
| 3,872,567 | 3/1975 | Cea et al. . | |
| 5,030,123 | 7/1991 | Silver | 439/188 |
| 5,244,402 | 9/1993 | Pasterchick, Jr. et al. | 439/217 |
| 5,269,708 | 12/1993 | DeYoung et al. | 439/676 |
| 5,305,380 | 4/1994 | Hileman et al. | 379/445 |
| 5,775,951 | 7/1998 | Gargiulo | 439/640 |
| 5,832,603 | 11/1998 | Fallandy | 29/861 |
| 5,838,550 | 11/1998 | Morris et al. | 361/818 |
| 5,876,240 | 3/1999 | Derstine et al. | 439/490 |

*Primary Examiner*—Carl J. Arbes

*Attorney, Agent, or Firm*—Allen, Dyer, Doppelt, Milbrath & Gilchrist, P.A.

[57] ABSTRACT

A method of inserting color coded wires into a multiple position modular registered jack connector of a telephone connection interface is disclosed. Individual wires that have been exposed by stripping the insulator covering from the end of a phone line are arranged by color in a wire insertion tool having a wire insertion end and pin depression member and grooves on a top surface that are also color coded in an order representing the order in which the ends of the color coded wires are to be placed into the modular registered jack connector. The grooves are dimensioned to receive in a frictional fit the respective color coded wires of the phone line. The wire insertion tool is moved manually into position such that the ends of the wires extend beyond the wire insertion end of the wire insertion tool and are aligned with conductive pins and associated teeth that pierce the insulation on wire, and the associated slots. The wire insertion tool is pushed straight toward the modular registered jack connector for inserting the ends of the wires into the respective slots such that the pin depression member depresses the conductive pins and the ends of the wires engage the conductive pins and associated teeth such that the insulation of the ends of the wire is pierced. The wire insertion tool is then removed from the color coded wires after the ends of the wires are received into the modular registered jack connector.

5 Claims, 4 Drawing Sheets

METHOD FOR INSERTING WIRES INTO A TELEPHONE JACK CONNECTOR

FIELD OF THE INVENTION

This invention relates to the field of telephone connection interfaces, and more particularly, this invention relates to the field of multiple position modular registered jack connectors, such as a receptacle and plug that interface together.

BACKGROUND OF THE INVENTION

Registered jacks are usually described under the acronym RJ-XX and are a series of telephone connection interfaces that include a receptacle and plug. These jacks are registered with the U.S. Federal Communications Commission (FCC). They are efficiently designed and have evolved from the various interfaces that were part of the AT&T universal service order code (USOC). The term "registered jack" or "registered jack connector" or simply "jack" is often used in the industry and refers to both a receptacle and/or plug and sometimes just the receptacle. One common telephone registered jack connector is an RJ-11 jack having six conductors, but usually used with four conductors. The RJ-11 registered jack connector is usually used in household or office phone environments and plugged into ordinary "untwisted" wire (often called "flat wire" or "gray satin" wire). Sometimes these jacks connect to "outside" and longer wires commonly referred to as twisted pair wire, which also connect to a telephone company central office or private branch exchange (PBX). The different four wires are typically color coded as a red and green pair and a black and white pair, respectively. The red and green pair of telephone lines usually carry voice or data. On an outside telephone company connection, the black and white pair can be used for low voltage signals, such as phone lights. On a PBX system, on the other hand, the black and white pair could be used for other kinds of signaling commonly used in PBX applications. A computer modem is typically connected to an RJ-11 jack.

One very common type of single line jack used for digital transmission over ordinary phone lines is an RJ-45 jack, which is becoming more common in use. Either untwisted or twisted phone wire can be used with this jack. The RJ-45 jack has eight positions or pins. If a modem, printer or data PBX is connected and a data rate up to 19.2 KBPS desired, untwisted wire can be used. It is possible to obtain faster transmissions when a connection is made via an Ethernet 10 base T network where twisted pair wire is used. Untwisted wire is usually a flat wire similar to common household phone extension wire, while twisted is often round. The RJ-45 jack can be both keyed and unkeyed where the keyed jack has a small bump on its end and the female complements it.

Twisted pair wiring typically dominates the wiring commonly used in facilities having both LAN and telephone wiring. Unshielded twisted pair (UTP) wire is in wide use when 19–26 gauge individual wires in a wire bundle are used. Premises wire is usually 24–26 gauge (AWG with commonly two twists per foot).

The twisting of a telephone wire pair cancels out radiated energy from current flowing in one wire by the radiated energy from the same return current that flows in the return wire of the same pair. Thus, crosstalk is minimized between adjacent pairs of wire. Twisting the individual wires also makes a wire pair less susceptible to external noise because the noise is coupled equally into each wire pair. Thus, noise is canceled out when wires are properly terminated. At voice frequencies, the wire pair would appear to be balanced. Equal energy would be emitted from each wire within the pair to any point outside the pair wires.

Often, the unshielded twisted pair cabling is used in Ethernet and token ring applications. The wires connect to a network interface card, as is well known to those skilled in the art. Four wires are used in a hub to NIC cable. The RJ-45 connectors are commonly used for a UTP connection. In addition to the RJ-45 connectors, a color coding scheme is used for a UTP connection. For example, some UTP category three cables use a solid and striped wire color scheme, such as orange and orange/white, blue and blue/white, green and green/white and brown and brown/white. The solid and striped color combinations are used to determine which pairs of wires must be twisted together in a specific sequence to provide adequate signaling. For example, the wires would be connected to various pins and receiving slots in the jack depending on the end use application. For example, an Ethernet 10 base-T connection could use pins 1 and 2 and 3 and 6, while a token-ring UTP connection could use pins 4 and 5 and 3 and 6.

With the increased use of RJ-45 modular telephone jacks in different applications, it is common now to connect individual wires, such as from a wire bundle, directly into the grooves or slots (i.e., wire receiving areas) of a jack to connect the wire to the conductive pins. This wire insertion process may not be difficult for experienced wire handlers and technicians, who work with the wire bundles and jacks everyday. However, for less experienced users, such as a residential user or handicapped person, the manual placing of individual wires into these jacks can be very difficult.

SUMMARY OF THE INVENTION

It is therefore an object of the present invention to provide a method of simply and efficiently inserting wires into a multiple position modular registered jack connector (RJ) of a telephone connection interface.

The method of the present invention now provides an efficient method of inserting wires, such as the color coded wires of a wire bundle, into a multiple position modular registered jack connector (RJ) of a telephone connection interface having a plurality of pins and associated teeth for piercing the insulation on wire, and associated wire receiving slots for receiving wires. In accordance with the method of the present invention, the insulator covering from the end of the phone line is stripped to expose a portion of the ends of the individual wires that form the wire bundle to form a plurality of loose color coded wires. For example, about an inch of insulator covering could be stripped from the end of the phone line. In one aspect of the present invention, eight loose color coded wires are formed when the end portion of the insulator covering is removed. The phone line has a corresponding number of wires corresponding to the number of wires to be received within a multiple position modular registered jack connector.

The color coded wires are arranged by color in an order corresponding to the order of the color coding scheme of a wire insertion tool that is formed from a substantially rigid body having a wire insertion end with a pin depression member and a top surface. A plurality of substantially parallel extending grooves are formed on the top surface and extend rearward from the wire insertion end. The grooves are color coded in an order representing the order in which the color coded wires are to be placed into the modular registered jack connector. The grooves are dimensioned to receive in a frictional fit the respective color coded wires from the phone line. Each loose color coded wire is inserted into the respective color coded groove of the wire insertion tool by matching colors on the wire insertion tool with the colors of the wires such that only the ends of each color coded wire extend beyond the wire insertion end of the wire insertion tool.

The wire insertion tool is grasped by hand and manually moved into a position such that the ends of the wires extend beyond the wire insertion end of the wire insertion tool and are aligned with the pins, teeth and associated wire receiving slots. The wire insertion tool is pushed straight toward the modular registered jack connector for inserting the pin depression member into the jack connector and depressing the conductive pins and inserting the ends of the wires into the respective slots such that the ends of each wire engage the respective pins and associated teeth pierce the insulation. The wire insertion tool is then removed from the color coded wires after the ends of the color coded wires are received into the modular registered jack connector.

In still another method aspect of the present invention, the method includes the step of forming the body member of the wire insertion tool from a substantially rectangular material that is dimensioned about the width of the modular registered jack connector, such that the grooves for receiving the wires extend substantially across the top surface. The method also comprises the step of forming the body member such that the grooves extend longitudinally across the top surface of the body member. After stripping the covering from the end of the phone line, the method can further comprise the step of untwisting the color coded wires from each other. The method can also comprise the step of color coding the grooves of the wire insertion tool with an alternating solid and striped color scheme corresponding to the twisting sequence of the wires. The method can also comprise the step of forming the body member from a substantially rigid material, such as plastic.

A wire insertion tool is also disclosed and inserts color coded wires into a multiple position modular registered jack (RJ) connector of a telephone connection interface having a plurality of pins and associated slots for receiving wires. A substantially rectangular configured body member is formed from a substantially rigid material. The body member has a wire insertion end, pin depression member on the wire insertion end and top surface.

A plurality of substantially parallel grooves are formed on the top surface of the body member and extend rearward from the wire insertion end. Each groove corresponds to a respective conductive pin and associated slot that receives a wire from a phone line. Each groove is color coded in the order representing the order in which the color coded wires are to be placed into the registered jack connector. The grooves are dimensioned to receive in a frictional fit the respective color coded wires of the phone line. The body member is formed to have a width about the width of a modular registered jack connector such that the formed grooves receive the loose wires that extend substantially across the top surface of the body member. The grooves are formed to extend longitudinally across the top surface of the body member. The color coding of the grooves can correspond to the twisting sequence of the wires from the phone line.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because it now allows a handicapped person or other individual that may have large hands without manual dexterity to insert the color coded wires from a telephone line into a multiple position modular registered jack connector (RJ) of a telephone connection interface with minimal difficulty. The use of the wire insertion tool of the present invention simplifies the wire insertion process. The wire insertion tool can also be manufactured at a low cost and is simple to operate.

Figure 1:
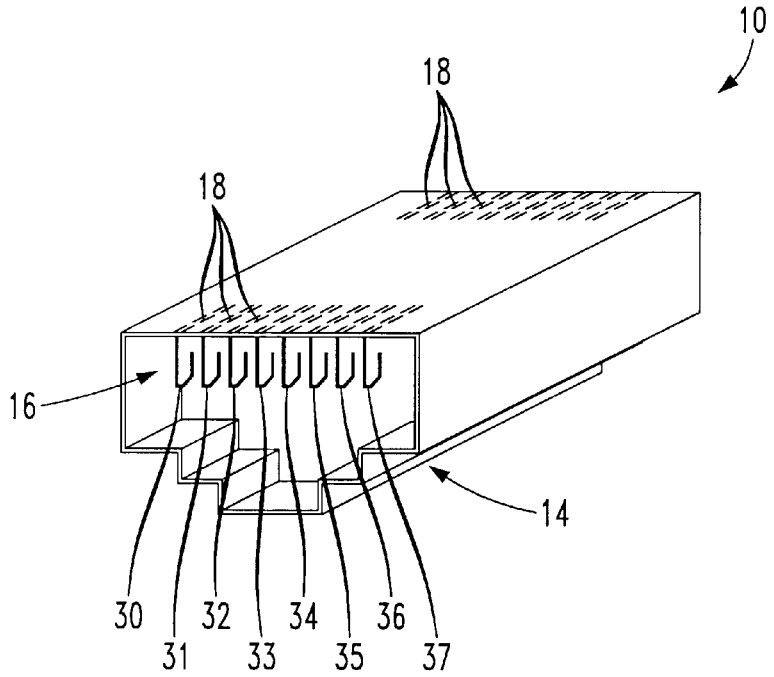
FIG. 1 is an isometric view of an RJ-45 modular registered jack connector that can be used with the wire insertion tool of the present invention.
Figure 2:
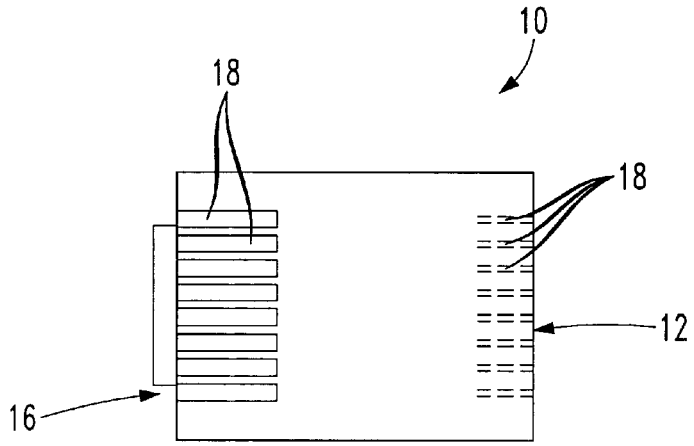
FIG. 2 is a schematic plan view of the jack shown in FIG. 1.
Figure 3:
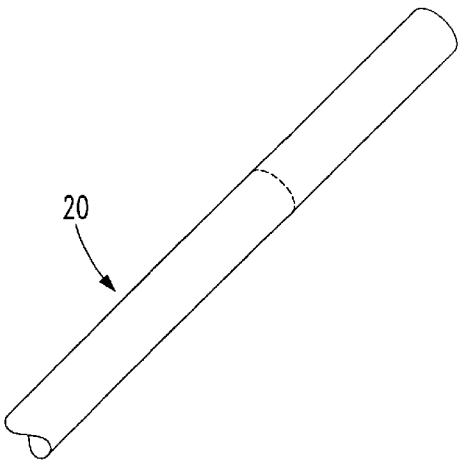
FIG. 3 is a drawing of a wire bundle that shows by dotted line what portion of its end will be stripped.

Referring now to FIGS. 1 and 2, there is illustrated a multiple position modular registered jack connector (RJ) 10 of a telephone connection interface that is illustrated as an RJ-45 connector or "jack." The term "jack" or "jack connector" or "registered jack connector" (RJ), as used herein, can apply to both the plug 12 shown in FIG. 2 and the jack end 14 shown in FIG. 1 or in some instances, both plug and jack. As is common with the RJ-45 jack connector 10 as illustrated and other similar registered jacks, such as an RJ-11 jack connector (not shown), a plurality of conductive pins 16 are positioned within the jack connectors. The pins 16 have associated teeth such that when pins 16 are depressed and the end of a wire received, the teeth then pierce the insulation covering on the wire, as is known to those skilled in the art, to have the pins/teeth engage the conductive portions of the wire. The pins 16 could be formed as jack springs as is known to those skilled in the art. In accordance with the present invention, there are also associated wire receiving slots 18 that extend adjacent the pins 16 and receive individual wires such as from a wire bundle 20 as shown in FIG. 3. In the present description, the wire bundle 20 is used to connect to an RJ-45 jack connector 10 having eight different conductive pins (labeled 30–37) corresponding to eight different color coded wires that will be inserted into the multiple position modular registered jack connector 10. The wires would have to be inserted into a jack end 14 or plug 12, depending on end use and requirements. As noted before, the color coding scheme can correspond to a desired insertion of various pairs of color coded wires.

Figure 5:
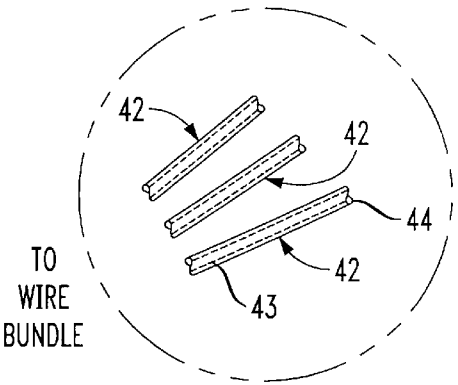
FIG. 5 is an enlarged view of the ends of three different color coded wires showing their end insulation.
Figure 4:
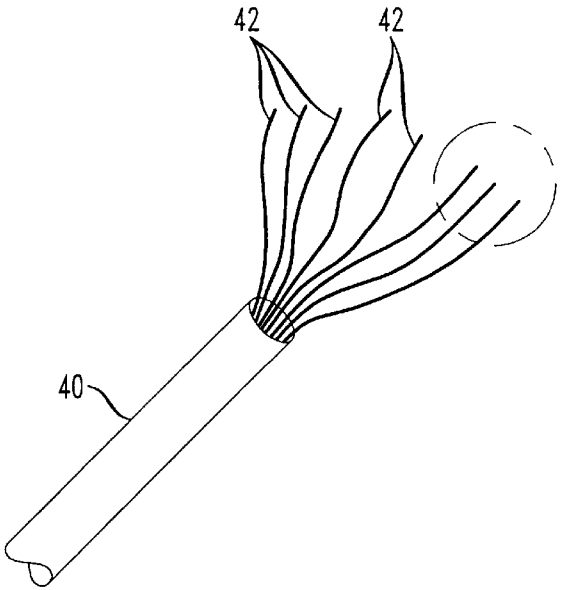
FIG. 4 is the drawing of the wire bundle of FIG. 3 showing its end stripped and exposing eight different color coded wires.

In accordance with the present invention, the insulator covering 40 is stripped from the end of a phone line, such as the amount of covering shown in FIG. 3, which could be about an inch of covering to form a plurality of loose color coded wires 42 as shown in FIG. 4. The phone line has a corresponding number of wires 42 corresponding to the number of wires 42 to be received in the multiple position modular registered jack connector 10. In the drawings using an RJ-45 jack connector 10 with eight pins 30–37, eight wires 42 are illustrated, each wire having an insulator covering 44. Each wire has a central core of copper 43 or other conductor material known to those skilled in the art extends from each individual color coded wire 42, as shown in the enlarged view of FIG. 5.

Figure 9:
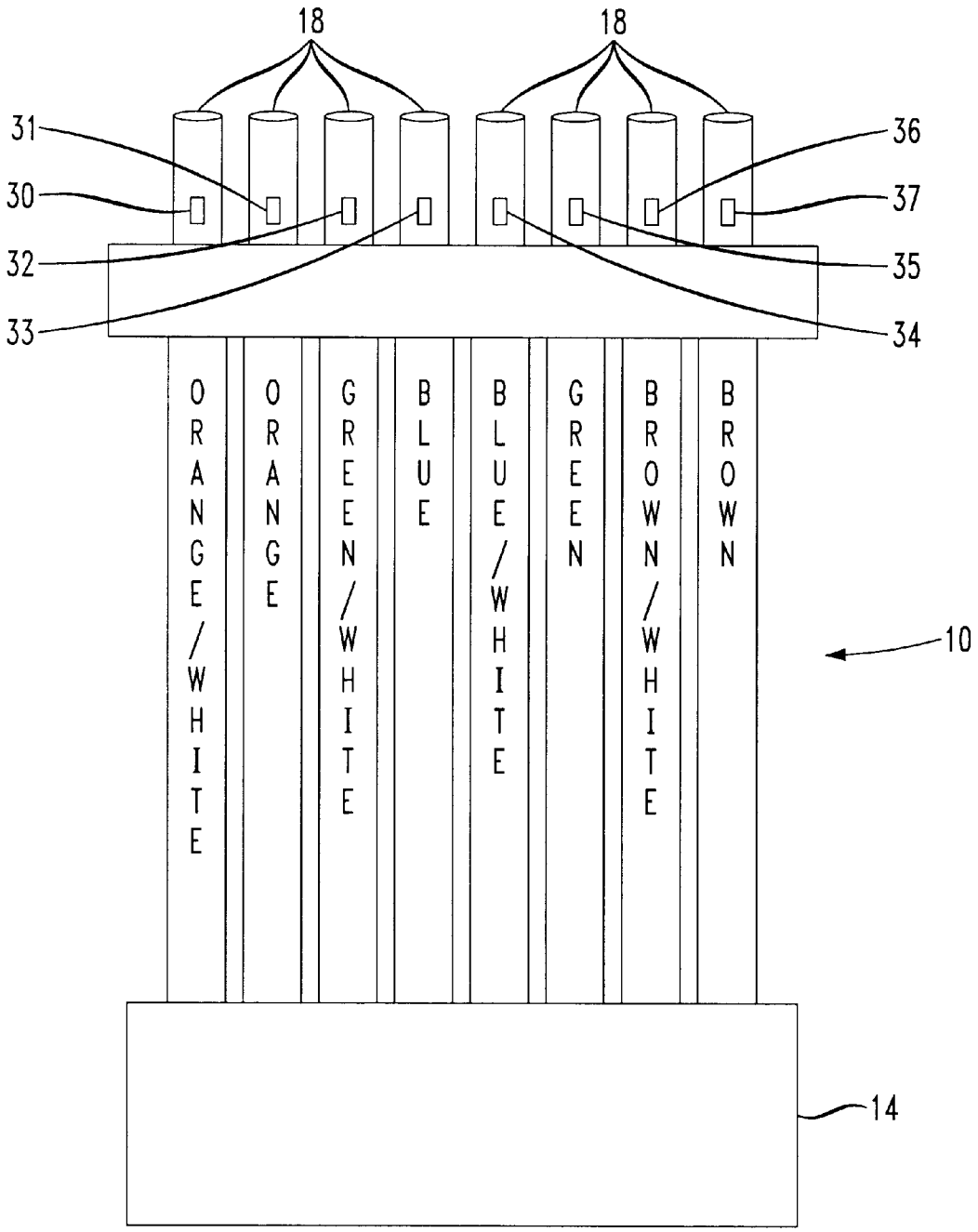
FIG. 9 ows one color coding scheme that could be used with the wire insertion tool that corresponds to a color coding scheme of an RJ-45 jack.

FIG. 9 illustrates a schematic view of an RJ-45 jack connector 10 with the color coding scheme for eight individual wires that are received within the grooves of the jack connector. The color coding scheme is shown with pin 1 (30) as orange/white and pin 2 (31) as orange. Pin 3 (32) is green/white and pin 4 (33) is blue. Pin 5 (34) is blue/white and pin 6 (35) is green. Pin 7 (36) is brown/white and pin 8 (37) is brown.

Each color coded wire 42 is then arranged by color in an order corresponding to the order of the color coding scheme of a wire insertion tool 50. In accordance with the present invention, the wire insertion tool 50 is formed from a substantially rectangular configured body member 52 that is formed from a substantially rigid material, such as a plastic material. Other materials as known to those skilled in the art could also be used. The body member 52 has a wire insertion end 54, and a top surface 56. A pin depression member 57 is formed at the wire insertion end 54 as a small flat protrusion that depresses the conductive pins when inserted into the jack to allow the associated teeth to pierce the insulation 44 on the wires. A plurality of substantially parallel grooves 58 are formed in the top surface 56 of the body member 52 and extend rearward from the wire insertion end 54. Each groove 58 corresponds to a respective parallel pin 30–37 and associated wire receiving slot 18 that receives a wire from a phone line. Thus, with the RJ-45 connector, the wire insertion tool has eight corresponding grooves 58 that are color coded such that the user aligns each color coded wire 42 with the respective color coded groove 58. Naturally, the wire insertion tool 50 could have any number of grooves 58 as long as the grooves are configured in a position and dimensioned to align the respective ends of the color coded wires with the respective areas of the registered jack connector that will receive the ends of the wire. Thus, each groove 58 is color coded in the order representing the order in which the color coded wires are to be placed in the registered jack connector 10. The grooves 58 are also dimensioned to receive in a frictional fit the respective color coded wires of the phone line.

The dimensions of the grooves for receiving each wire and the spacing of grooves can vary depending on the type of RJ jack connector 10 that is used. Examples of dimensions could include those dimensions evident in the connectors shown in U.S. Pat. No. 5,030,123 to Silver; U.S. Pat. No. 5,305,380 to Hileman et al.; U.S. Pat. No. 5,876,240 to Derstine et al.; the disclosures which are hereby incorporated by reference in their entirety. These patents are only representative examples showing different dimensions that can be used for different pin configurations. Typically, the grooves 58 are formed to have a slight interference fit with the 22 and 24 gauge wire typically used in RJ-45 applications such that the individual wires will not come out of the grooves unless forcibly removed by a user after the ends of the wire are connected into the modular connector jack.

Figure 6:
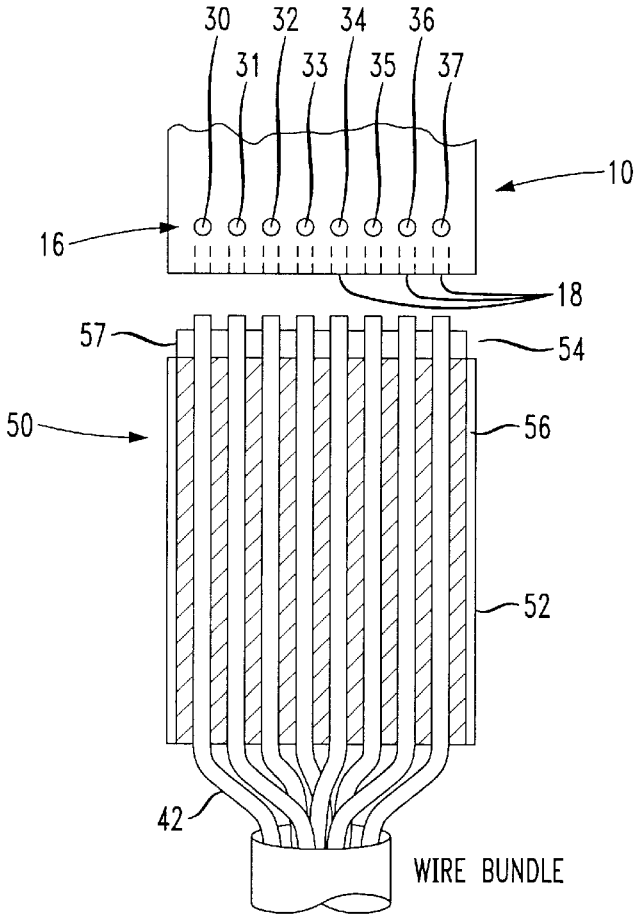
FIG. 6 shows eight different color coded wires that are inserted into the grooves of a wire insertion tool of the present invention and aligned with a multiple position modular registered jack connector, such as an RJ-45 jack.
Figure 7:
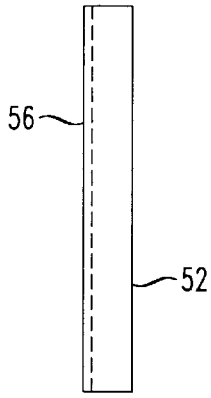
FIG. 7 is a side elevation view of the wire insertion tool shown in FIG. 6.
Figure 8:
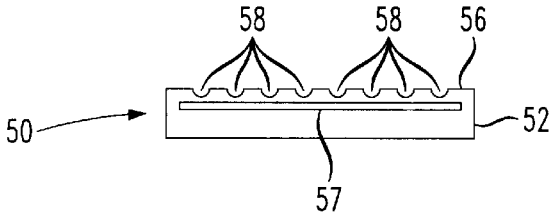
FIG. 8 is a rear elevation view of the wire insertion tool of FIG. 6 showing the grooves formed within the top surface.

Typically, the body member 52 is formed to have a width about the width of a modular registered jack connector 10, such that the formed grooves for receiving the loose strands of wire extend across substantially the top surface of the body member as shown in FIGS. 6 and 8. The grooves 58 are typically formed to extend longitudinally across the top surface 56 of the body member 52. The color coding of the grooves 58 can correspond to the twisting sequence of the wires from the phone line in one aspect of the present invention.

After the ends 43 of the color coded wires 42 are inserted into the respective color coded grooves 58 of the wire insertion tool 50, the wire insertion tool is grasped by hand and manually moved into a position such that the ends of the wires extend beyond the wire insertion end of the wire insertion tool and are aligned with the pins 30–37 and associated slots 18 of the modular registered jack connector 10. A greater amount of wire end can extend beyond the wire insertion tool 50 than that amount shown in FIG. 6. The wire insertion tool 50 is pushed straight toward the modular registered jack connector 10 and the individual ends of each color coded wire is inserted into the respective wire receiving slots 18, and the pin depression member 57 depresses the conductive pins. The associated teeth pierce the insulator covering 44 on each wire and then the ends of each wire engage a respective pin. The wire insertion tool 50 is then removed from the color coded wires after the ends of the wires are received into the modular registered jack connector. Naturally, in a modular registered jack connector, the slots and pins are not limited in their design. The terms "slot" and "pin" are used generally for any type of wire receiving position in a modular registered jack connector having a connection interface for wires, as known to those skilled in the art.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A combination wire insertion tool and communications jack connector comprising:

a multiple position modular registered jack (RJ) connector of a telephone connection interface having a plurality of slots that receive color coded, individual wires of a wire bundle, said individual wires having insulation that covers conductor wire, and conductive pins and associated teeth formed at the slots for piercing the insulation of the individual wires as they are received in the slots;

a wire insertion tool comprising:

a substantially rectangular configured body member formed from a substantially rigid material, said body member having a wire insertion end, a pin depression member on the wire insertion end, and a top surface;

a plurality of substantially parallel grooves formed on the top surface of the body member and extending rearward from the wire insertion end, wherein each groove corresponds to a respective conductive pin and slot in said modular registered jack (RT) connector and frictionally receives a color coded, individual wire from a wire bundle of a phone line, such that each color coded individual wire has an end that extends beyond the wire insertion end, and wherein each groove is color coded in the order representing the order in which the color coded wires are inserted into the modular registered jack (RJ) connector, wherein the grooves receive in a frictional fit the respective color coded, individual wires of the phone line;

wherein said wire insertion end of said wire insertion tool and multiple position modular registered (RJ) jack connector are connected together such that said pin depression member biases the pins and teeth, and said conductive pins and teeth pierce the insulation such that the conductive pins and teeth engage the conductor wire and lock the individual wires into the multiple position modular registered (RJ) connector upon subsequent removal of the wire insertion tool.

2. A wire insertion tool according to claim 1, wherein said body member is formed to have a width about the width of a modular registered jack connector such that the formed grooves that receive the color coded, individual wires extend across substantially the top surface of the body member.

3. A wire insertion tool according to claim 1, wherein said grooves are formed to extend longitudinally across the top surface of the body member.

4. A wire insertion tool according to claim 1, wherein the color coding of said grooves corresponds to the twisting sequence of the wires from the a wire bundle of a line.

5. A combination wire insertion tool and communications jack connector comprising:

a multiple position modular registered jack (RJ) connector of a telephone connection interface having a plurality of slots that receive color coded, individual wires or wire bundle, said individual wires having insulation that covers conductor wire, and conductive pins and associated teeth formed at the slots for piercing the insulation of the individual wires as they are received in the slots;

a wire insertion tool comprising:

a substantially rectangular configured body member formed from a substantially rigid material, said body member having a wire insertion end, a pin depression member on the wire insertion end, and a top surface;

a plurality of substantially parallel grooves formed on the top surface of the body member and extending longitudinally across the top surface of the body member and extending rearward from the wire insertion end, wherein each groove corresponds to a respective conductive pin and slot in said modular registered jack (RJ) connector that frictionally receives a color coded, individual wire from a wire bundle of a phone line such that each color coded individual wire has an end that extends beyond the wire insertion end, and wherein each groove is color coded in the order representing the order in which the color coded wires are inserted into the modular registered jack (RJ) connector, wherein the grooves receive in a frictional fit the respective color coded, individual wires of the wire bundle, said body member having a width about the width of the modular registered jack connector such that the formed grooves that receive the color coded, individual wires extend across substantially the top surface of the body member and extend longitudinally across the top surface and the color coding of the grooves corresponds to the twisting sequence of wires from a wire bundle of a phone line; and wherein said wire insertion end of said wire insertion tool and multiple position modular registered jack connector are connected together such that said pin depression member biases the pins and teeth, and said pins and teeth pierce the insulation on said individual wire such that the conductive pins and teeth engage the conductor wire and lock the individual wires into the multiple position modular registered (RJ) connector upon subsequent removal of the wire insertion tool.

* * * * *